US010890097B1

(12) United States Patent
Kurzynski et al.

(10) Patent No.: US 10,890,097 B1
(45) Date of Patent: Jan. 12, 2021

(54) COOLING SYSTEMS FOR MARINE ENGINES HAVING OFFSET TEMPERATURE-RESPONSIVE DISCHARGE VALVES

(71) Applicant: Brunswick Corporation, Mettawa, IL (US)

(72) Inventors: Adam J. Kurzynski, Neenah, WI (US); Chetan Avinash Dharmadhikari, North Fond du Lac, WI (US); Paul M. Radavich, Eldorado, WI (US)

(73) Assignee: Brunswick Corporation, Mettawa, IL (US)

( * ) Notice: Subject to any disclaimer, the term of this patent is extended or adjusted under 35 U.S.C. 154(b) by 213 days.

(21) Appl. No.: 15/985,792

(22) Filed: May 22, 2018

(51) Int. Cl.

| | |
|---|---|
| ***F01P 3/20*** | (2006.01) |
| ***F01P 3/02*** | (2006.01) |
| ***F01N 13/00*** | (2010.01) |
| ***B63H 20/28*** | (2006.01) |
| ***F01P 5/12*** | (2006.01) |
| *B63H 20/24* | (2006.01) |
| *F01P 3/00* | (2006.01) |

(52) U.S. Cl.
CPC ..... *F01P 3/202* (2013.01); *B63H 20/28* (2013.01); *F01P 3/02* (2013.01); *F01P 5/12* (2013.01); *B63H 20/24* (2013.01); *F01N 13/004* (2013.01); *F01N 2260/024* (2013.01); *F01P 2003/001* (2013.01); *F01P 2005/125* (2013.01); *F01P 2050/04* (2013.01); *F01P 2060/16* (2013.01)

(58) Field of Classification Search
CPC ..... F01P 3/202; F01P 3/02; F01P 5/12; F01P 7/14; F01P 7/165; F01P 11/04; F01P 2003/027; F01P 2003/028; F01P 2003/001; F01P 2005/125; F01P 2007/146; F01P 2050/02; F01P 2050/04; F01P 2060/16; F01N 13/004; F01N 2260/024; B63H 20/28; B63H 20/24
See application file for complete search history.

(56) References Cited

U.S. PATENT DOCUMENTS

| | | | |
|---|---|---|---|
| 3,818,418 | A | 6/1974 | Detch |
| 4,082,068 | A | 4/1978 | Hale |
| 4,674,449 | A | 6/1987 | Hundertmark |
| 5,121,787 | A | 6/1992 | Corbett |
| 5,329,888 | A | 7/1994 | Luckett et al. |
| 5,515,815 | A | 5/1996 | Phillips |
| 5,642,691 | A | 7/1997 | Schroeder |
| 5,746,270 | A | 5/1998 | Schroeder et al. |

(Continued)

*Primary Examiner* — Grant Moubry
(74) *Attorney, Agent, or Firm* — Andrus Intellectual Property Law, LLP

(57) ABSTRACT

A marine engine has first and second banks of piston-cylinders, and first and second cooling water passages that convey cooling water in parallel alongside the first and second banks of piston-cylinders, respectively. A cooling water pump pumps the cooling water through the first and second cooling water passages. A first temperature-responsive valve is configured to discharge the cooling water from both of the first and second cooling water passages when the cooling water reaches a first temperature threshold. A second temperature-responsive valve is configured to discharge the cooling water from both of the first and second cooling water passages when the cooling water reaches a second temperature threshold that is greater than the first temperature threshold.

19 Claims, 11 Drawing Sheets

(56) References Cited

U.S. PATENT DOCUMENTS 5,832,888 A 11/1998 Griffiths et al.
5,970,926 A * 10/1999 Tsunoda ..... F01P 3/12 123/195 P
5,980,342 A 11/1999 Logan et al.
6,135,833 A * 10/2000 Tsunoda ..... B63H 20/28 440/88 C
6,405,689 B1 * 6/2002 Iijima ..... F01P 3/02 123/41.28
6,523,506 B2 * 2/2003 Hirano ..... F01P 7/16 123/41.1
6,682,380 B1 * 1/2004 Irwin ..... F01P 3/02 123/41.74
6,821,171 B1 11/2004 Wynveen et al.
6,976,892 B2 * 12/2005 Tawa ..... F01P 3/202 440/88 G
7,114,469 B1 10/2006 Taylor
7,207,298 B2 * 4/2007 Lee ..... F01P 7/165 123/41.05
7,318,396 B1 1/2008 Belter et al.
7,806,740 B1 10/2010 Taylor et al.
8,256,386 B2 * 9/2012 Watanabe ..... B62K 11/04 123/196 CP
8,402,930 B1 3/2013 Taylor et al.
8,500,501 B1 8/2013 Taylor et al.
8,539,929 B2 * 9/2013 Dees ..... F02F 1/40 123/198 E
8,696,394 B1 4/2014 Langenfeld et al.
8,739,745 B2 * 6/2014 Quix ..... F01P 7/165 123/41.02
8,763,566 B1 7/2014 Taylor et al.
8,967,091 B2 3/2015 Bellinger et al.
9,365,274 B1 6/2016 George et al.
10,293,911 B2 * 5/2019 Saruwatari ..... F01P 5/12
2002/0173208 A1 * 11/2002 Yonezawa ..... F01N 3/043 440/88 J
2010/0084111 A1 4/2010 Jaeger et al.
2017/0328265 A1 11/2017 George et al.

* cited by examiner

COOLING SYSTEMS FOR MARINE ENGINES HAVING OFFSET TEMPERATURE-RESPONSIVE DISCHARGE VALVES

FIELD

The present invention relates to cooling systems for marine engines, and particularly to cooling systems having temperature-responsive valves for discharging cooling water.

BACKGROUND

The following U.S. Patents are incorporated herein by reference:

U.S. Pat. No. 5,642,691 discloses a thermostat assembly for a marine engine having a closed loop cooling system provides an additional bypass for engine coolant flow.

U.S. Pat. No. 7,318,396 discloses a cooling system for a marine engine that incorporates first and second thermally responsive valves which are responsive to increases in temperature above first and second temperature thresholds, respectively. The two thermally responsive valves are configured in serial fluid communication with each other in a cooling system, with one thermally responsive valve being located upstream from the other.

U.S. Pat. No. 8,763,566 discloses a cooling system for a marine engine with various cooling channels that allow the advantageous removal of heat at different rates from different portions of the engine.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain non-limiting examples, a marine engine has first and second banks of piston-cylinders, and first and second cooling water passages that convey cooling water in parallel alongside the first and second banks of piston-cylinders, respectively. A cooling water pump pumps the cooling water through the first and second cooling water passages. A first temperature-responsive valve is configured to discharge the cooling water from both of the first and second cooling water passages when the cooling water reaches a first temperature threshold. A second temperature-responsive valve is configured to discharge the cooling water from both of the first and second cooling water passages when the cooling water reaches a second temperature threshold that is greater than the first temperature threshold.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

During research and experimentation, the present inventors have determined that conventional temperature-responsive valves (e.g., thermostats) for marine engines often have relatively large-diameter flow passages, making it difficult to achieve fine control over cooling water discharge flow. The present inventors have further determined that it is desirable to improve upon such systems, in particular so as to reduce thermal cycling, which especially can occur in cold water applications. The present inventors have also determined that it would be advantageous to provide independently-mounted temperature-responsive valves having offset (i.e., staggered) opening temperatures and having varying (i.e., relatively slow vs. relatively fast) opening rates. The inventors have also determined it is desirable to efficiently package such valves with respect to the marine engine so as to minimize size and weight. The present inventors have also determined that de-coupling and independently mounting the valves on respective engine heads advantageously allows for improved packaging, and reduced size and weight, as well as commonality of hardware, machined features, and assembly methods. This can be especially important in outboard motor applications. These and other advantages and improvements over the prior art are more fully disclosed herein below.

Figure 1:
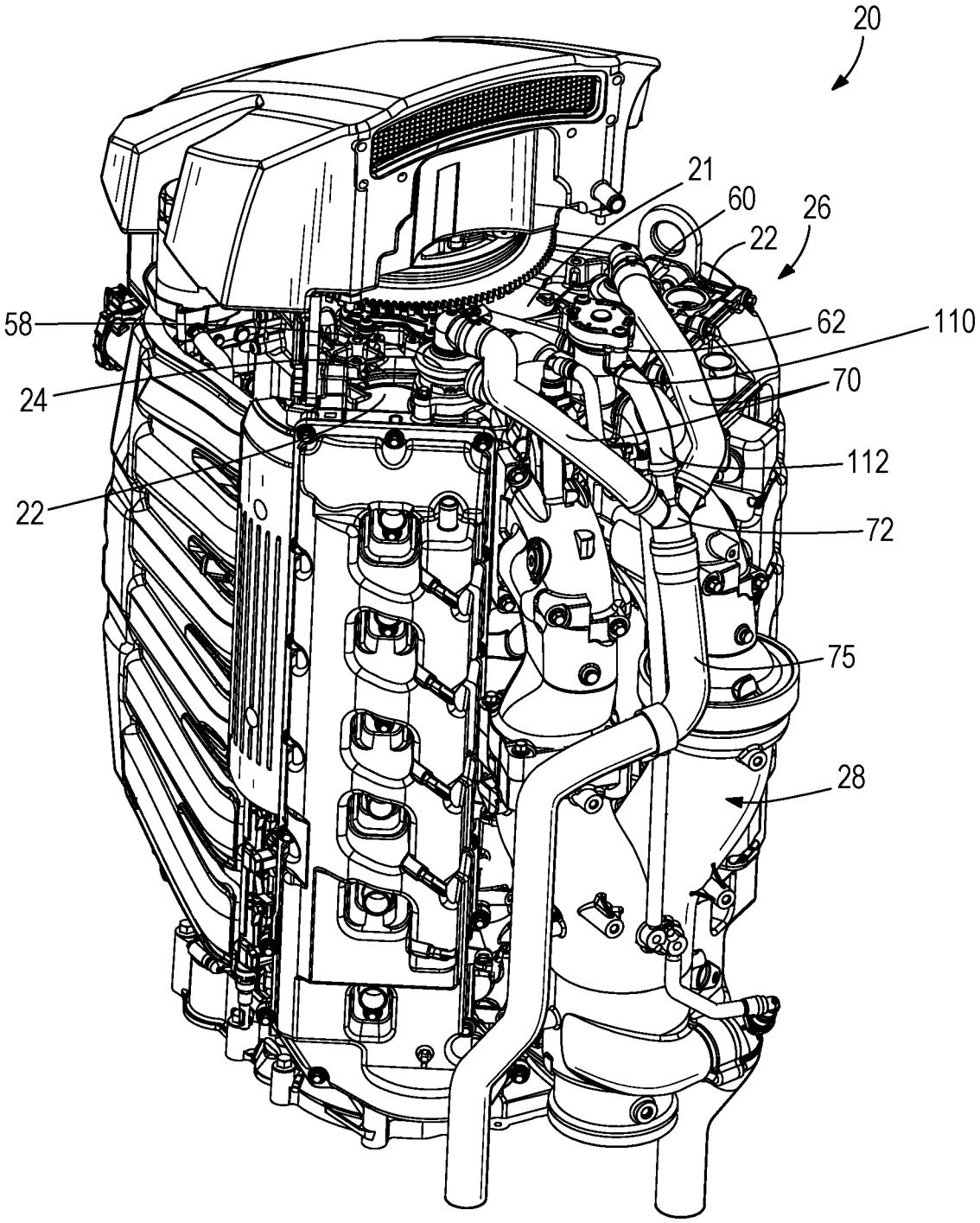
FIG. 1 is a perspective view of a marine engine for an outboard motor.

FIG. 1 depicts a marine engine 20 for an outboard motor. The marine engine 20 has an engine block 21 with vertically-aligned first and second banks of piston-cylinders 24, 26 that extend from each other to as to form a V-shape. A pair of cylinder head assemblies 22 is disposed on the engine block 21. As is conventional, combustion in the first and second banks of piston-cylinders 24, 26 causes rotation of a driveshaft, which in turn powers a corresponding propulsor (e.g., one or more propellers) for propelling a corresponding marine vessel in water. Exhaust gas is discharged from the marine engine 20 via a pair of exhaust logs 54, 56 (see FIG. 9) which are connected to an exhaust manifold 28 located within the V-shape. The exhaust manifold 28 conveys the exhaust gas to an underlying driveshaft housing for subsequent discharge to atmosphere and/or the body of water in which the outboard motor is operating. Further description of this type of arrangement is provided in U.S. Pat. No. 9,616,987 which is incorporated herein by reference.

It should be noted that FIG. 1 depicts only one example of a marine engine 20 for which the present invention can be implemented. The type and configuration of marine engine can vary from what is shown. The number of piston-cylinders can vary from what is shown. The present invention is useful with marine drives other than outboard motors, for example stern drives or inboard drives.

Figure 9:
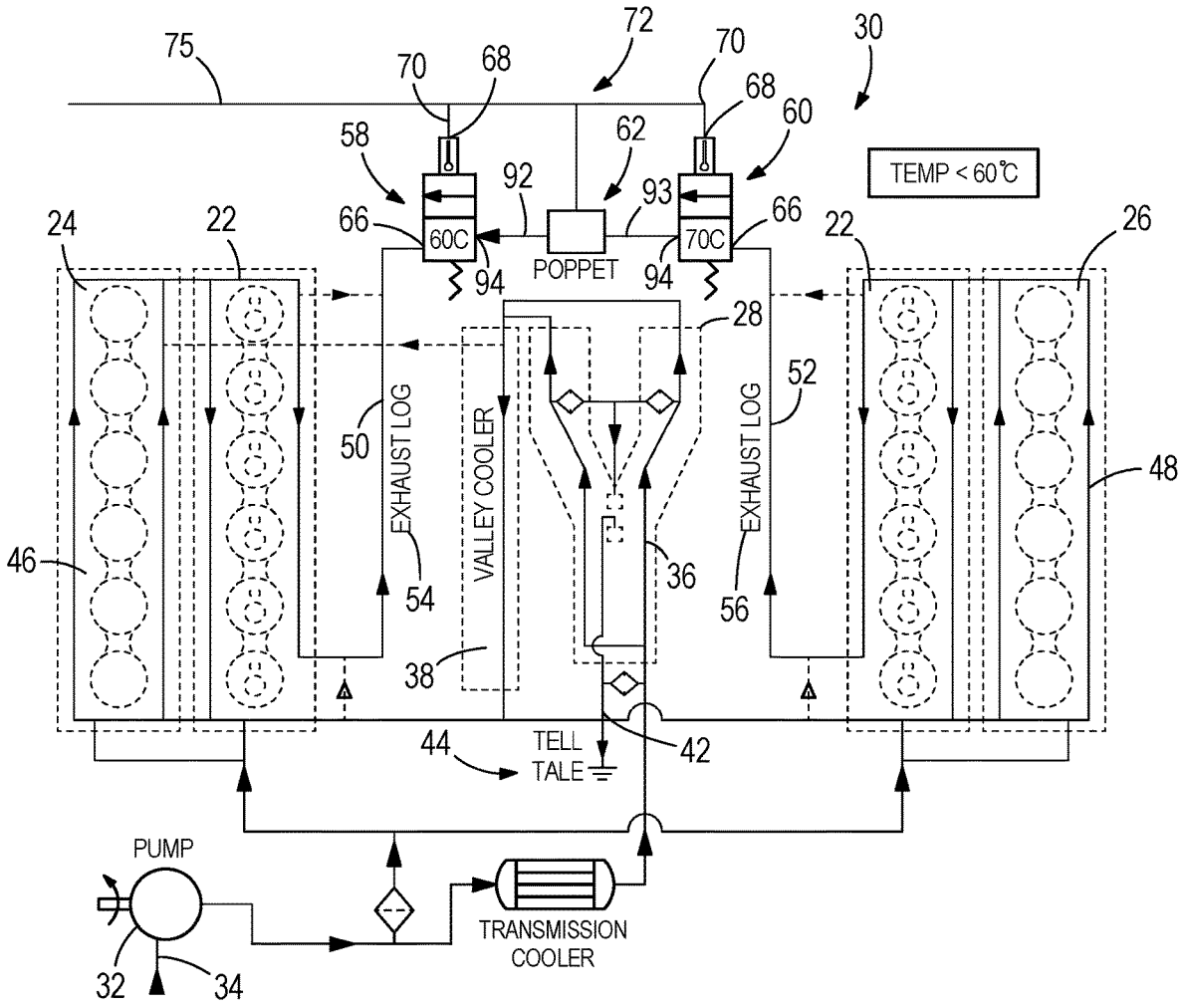
FIGS. 9-13 are schematic views of an exemplary cooling system according to the present disclosure showing a series of operational states of the first and second temperature-responsive valves and the pressure-responsive bypass valve.

Now referring to FIG. 9, a cooling system 30 conveys cooling water through the marine engine 20. A cooling water pump 32 draws water from the surrounding body of water in which the outboard motor is being operated. The cooling water enters the cooling system 30 via a cooling water inlet on the outboard motor and an associated cooling water inlet passage 34. The cooling water pump 32 can be a conventional item, for example an electric pump, mechanical pump, and/or combination electric-mechanical pump. The cooling water pump 32 can be mechanically powered by rotation of a driveshaft associated with the marine engine 20 and/or electrically powered for example by a battery. In other examples, there can be more than one cooling water pump 32.

The cooling water pump 32 pumps the cooling water through a cooling water passage 36 on the exhaust manifold 28 and then through a cooling water passage 38 on a valley cooler (i.e., oil cooler). As the relatively cold cooling water is conveyed through the respective cooling water passages 36, 38, it exchanges heat with these components so that the components and contents thereof are cooled. A telltale conduit 42 is connected to the cooling water passage 36 and discharges cooling water to the surrounding body of water via a telltale outlet 44, as is conventional.

The cooling water pump 32 further pumps the cooling water in parallel through first and second cooling water passages 46, 48 formed in the engine block 21 alongside first and second banks of piston-cylinders 24, 26, respectively and cylinder head assemblies 22. The relatively cold cooling water exchanges heat with and cools the relatively hot banks of piston-cylinders 24, 26 and cylinder head assemblies 22. The cooling water is then conveyed in parallel through first and second cooling water passages 50, 52 on first and second exhaust logs 54, 56, which as mentioned above convey exhaust gas from the first and second banks of piston-cylinders 24, 26 to the exhaust manifold 28. The first and second cooling water passages 50, 52 are located alongside of the first and second exhaust logs 54, 56 so that the relatively cold cooling water exchanges heat with and cools the relatively hot first and second exhaust logs 54, 56 and the exhaust gas therein.

Figure 2:
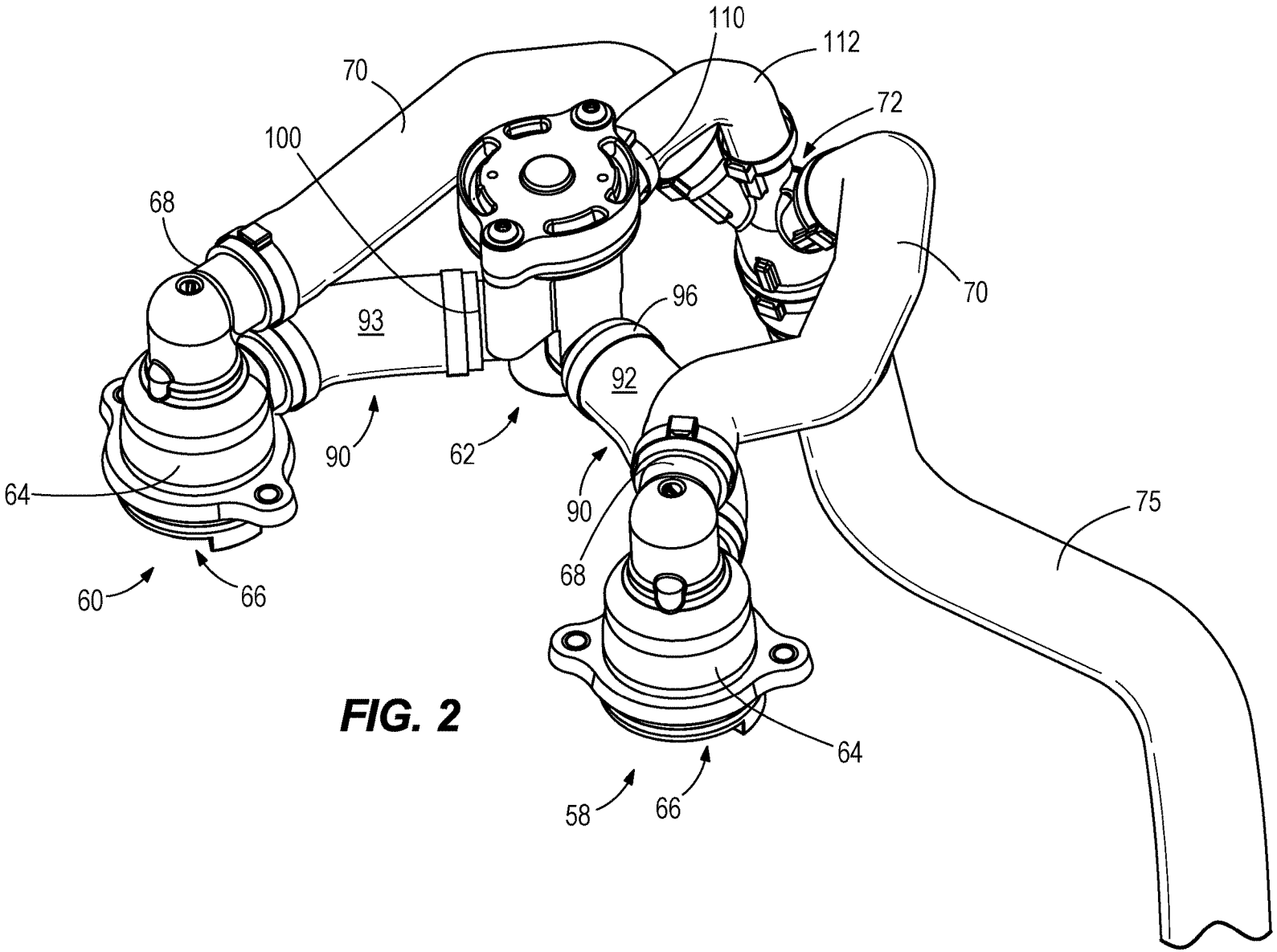
FIG. 2 is a perspective view of first and second temperature-responsive valves and a pressure-responsive bypass valve for discharging cooling water from the marine engine.
Figure 3:
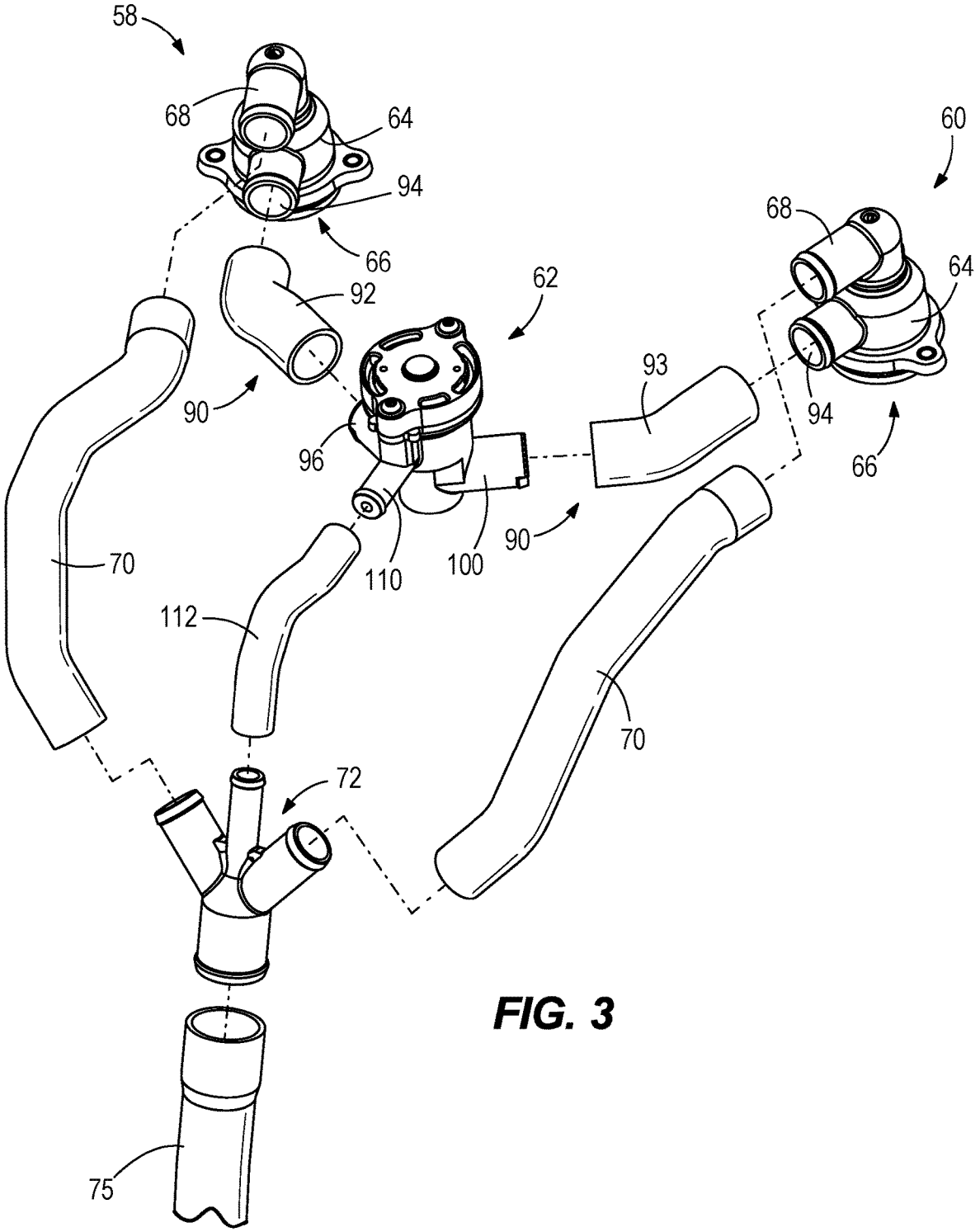
FIG. 3 is an exploded view of what is shown in FIG. 2.

Referring to FIGS. 2, 3 and 9, the cooling system 30 further includes a first temperature-responsive valve 58, a second temperature-responsive valve 60 and a pressure-responsive bypass valve 62. As described further herein below, these devices are specially configured to provide fine control over discharge of cooling water from the system 30. The first temperature-responsive valve 58 is specially configured to discharge the cooling water from both of the first and second cooling water passages 46, 48 when the cooling water therein reaches a first temperature threshold. The second temperature-responsive valve 60 is specially configured to discharge the cooling water from both the first and second cooling water passages 46, 48 when the cooling water therein reaches a second temperature threshold that is greater than the first temperature threshold. The pressure-responsive bypass valve 62 is specially configured to discharge cooling water from the cooling system 30 when the cooling water reaches a pressure threshold.

Referring to FIGS. 1-3, the first temperature-responsive valve 58 is coupled to the engine block 21 and cylinder head assemblies 22 at a location that is closer to the first bank of piston-cylinders 24 than the second bank of piston-cylinders 26. In this example, the first temperature-responsive valve 58 is mounted on top of or otherwise above the cylinder head assembly 22 on the first bank of piston-cylinders 24. The second temperature-responsive valve 60 is coupled to the engine block 21 and cylinder head assemblies 22 closer to the second bank of piston-cylinders 26 than the first bank of piston-cylinders 24. In this example, the second temperature-responsive valve 60 is mounted on top of or otherwise above the cylinder head assembly 22 of the second bank of piston-cylinders 26. The first and second temperature-responsive valves 58, 60 each have a body 64 with an inlet 66 that is connected in fluid communication with the respective first and second cooling water passages 50, 52 on the first and second exhaust logs 54, 56, so as to receive cooling water flow from the first and second cooling water passages 50, 52. The body 64 further includes an outlet 68 that discharges the cooling water to an outlet conduit 70. The respective outlet conduits 70 on the first and second temperature-responsive valves 58, 60 merge the cooling water flow together at a junction fitting 72, which is connected to a discharge conduit 75 for discharging the cooling water to the lower portions of the outboard motor and/or the surrounding body of water.

Figure 5:
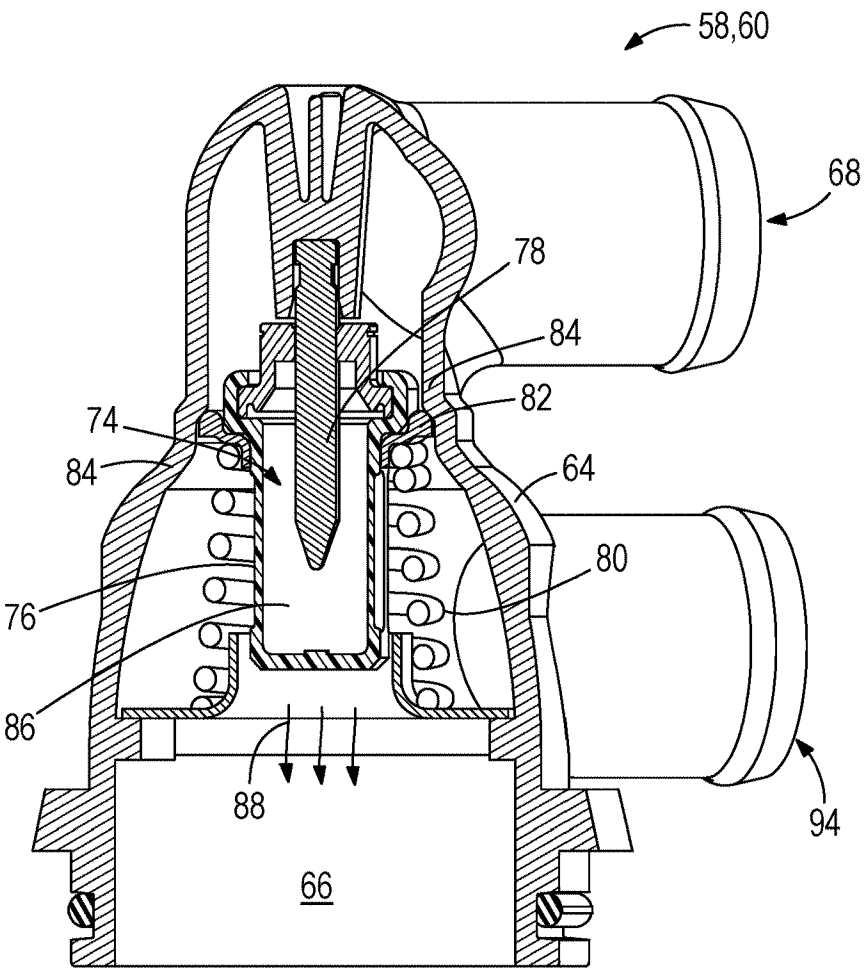
FIG. 5 is a sectional view of the valve shown in FIG. 4.
Figure 4:
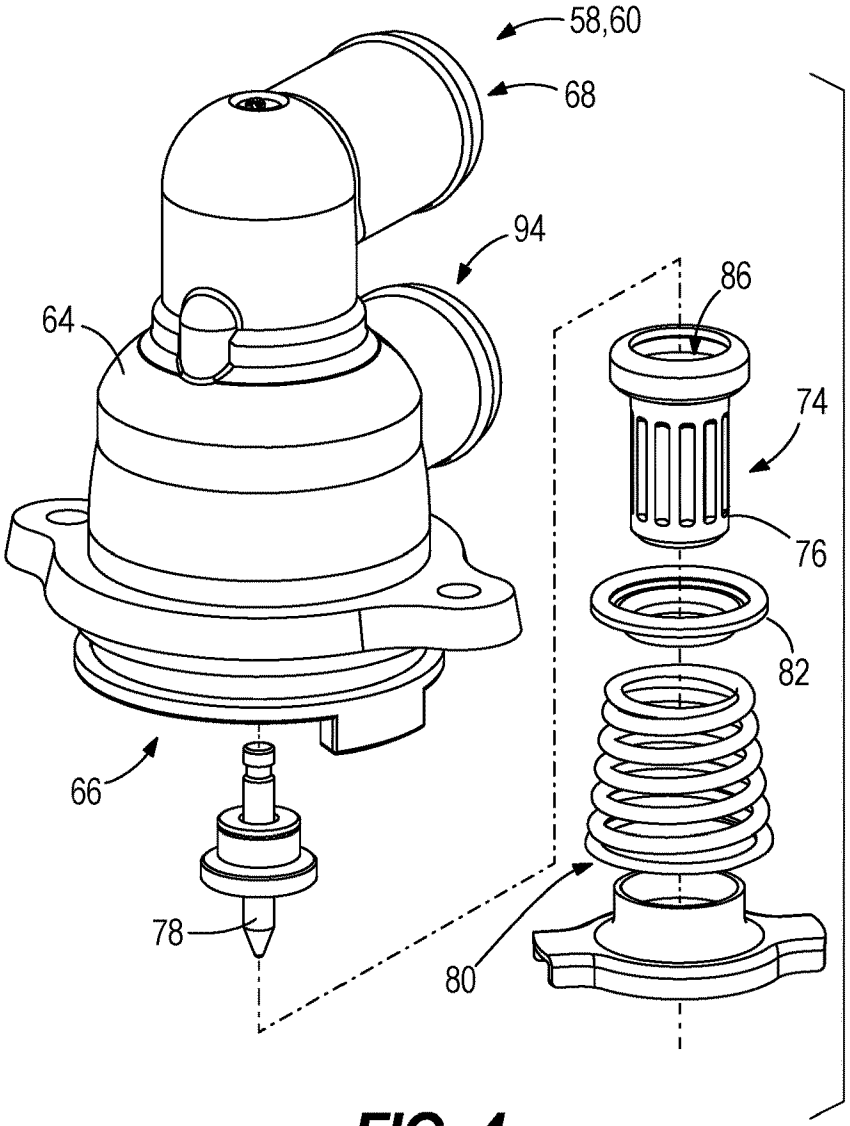
FIG. 4 is an exploded view of a representative one of the temperature-responsive valves.
Figure 7:
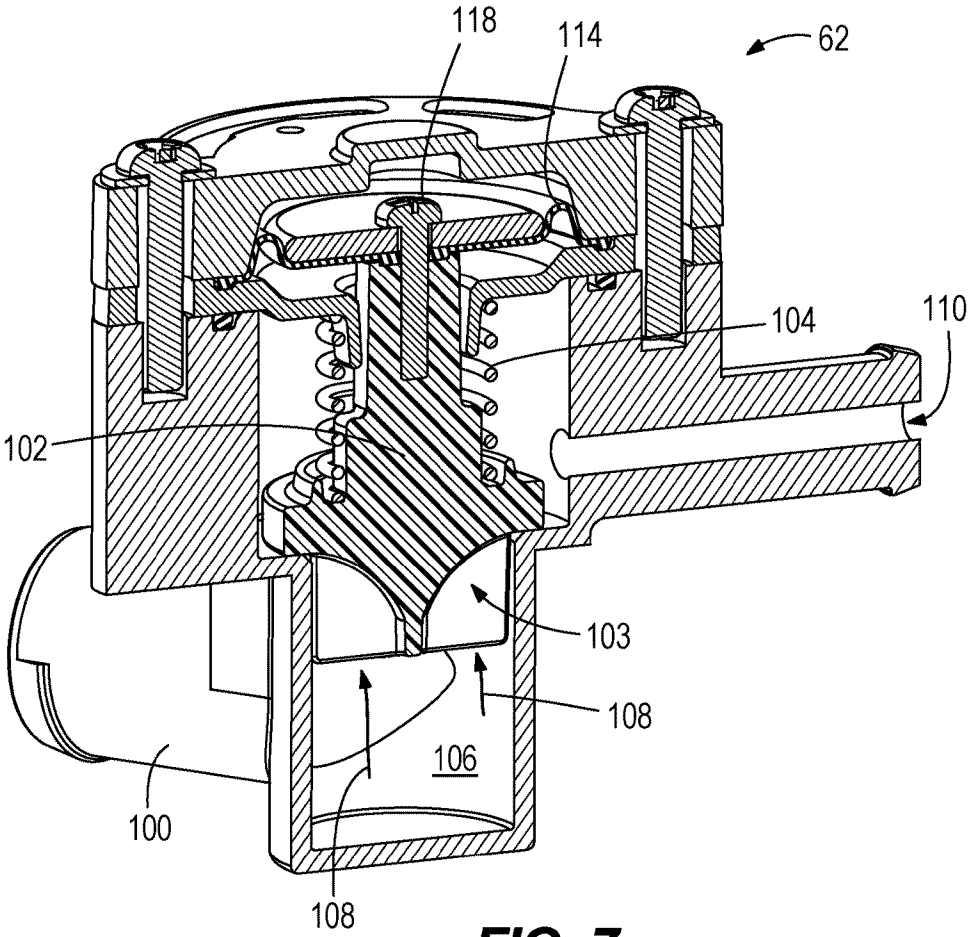
FIG. 7 is a sectional view of the valve shown in FIG. 6.
Figure 6:
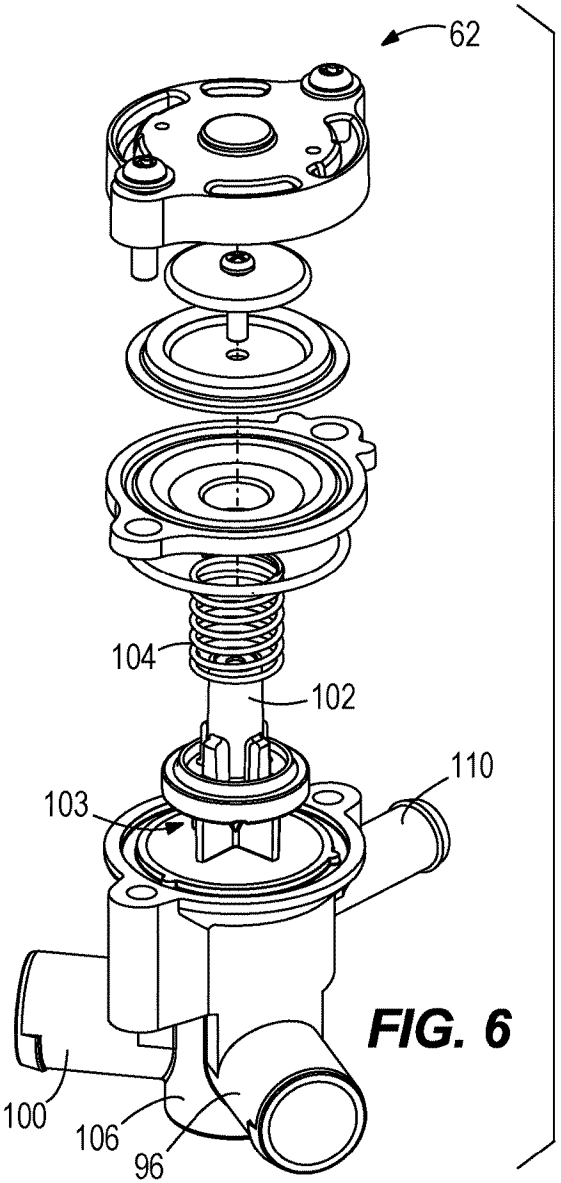
FIG. 6 is an exploded view of the pressure-responsive bypass valve.

Referring to FIGS. 4 and 5, the first and second temperature-responsive valves 58, 60 each have a temperature-responsive element 74 which, based upon the temperature of the cooling water, automatically opens to allow flow of the cooling water from the inlet 66 to the outlet 68 and automatically closes to prevent flow of the cooling water from the inlet 66 to the outlet 68. More specifically, the first and second temperature-responsive valves 58, 60 each have a generally cylindrical wax element 76 that reciprocates up and down with respect to a tapered rod 78 based on the temperature of the cooling water. The tapered rod 78 extends into the wax element 76. The wax element 76 is biased by a compression spring 80 into the seated position shown in FIG. 5, wherein the tapered rod 78 is located mostly within the wax element 76 and the annular sealing ring 82 on the wax element 76 is sealed with an inwardly directed annular shoulder 84 of the body 64. In this position, the cooling water is prevented from flowing from the inlet 66 to the outlet 68. As the temperature of the cooling water increases past a temperature threshold, the temperature of the wax 86 within the wax element 76 also increases, which in turn causes the wax 86 to expand and push radially inwardly against the tapered rod 78. This pushes the wax element 76 downwardly in the direction of arrows 88 in FIG. 5, along the taper of the rod 78 and against the bias of the compression spring 80, thus unseating the sealing ring 82 from the annular shoulder 84 and allowing flow of cooling water through the body 64 from the inlet 66 to the outlet 68. When the temperature of the cooling water decreases below the temperature threshold, the temperature of the wax 86 also decreases which causes it to contract and allows the bias of the compression spring 80 to force the wax element 76 back against the taper of the rod 78 and into the seated position shown in FIG. 5. The above-described device is often referred to in the art as a "thermostat", the type and/or configuration of which can vary from what is shown. Examples of suitable thermostats can be purchased from commercial suppliers such as Stant Corporation. However, as further explained herein below, the present inventors have determined that the type and/or configuration of the wax 86 and/or spring 80 can be intentionally selected by the system designer so as to provide fine control over when and how quickly the wax element 76 reacts to changes in temperature of the cooling water. As further described herein below, this advantageously provides fine control over cooling water discharge.

Referring to FIGS. 2 and 3, a cross-over conduit 90 permits flow of the cooling water from the first cooling water passage 46 (in this example via the first cooling water passage 50) to the second temperature-responsive valve 60 and alternately from the second cooling water passage 48 (in this example via the second cooling water passage 52) to the first temperature-responsive valve 58. As further explained herein below, the cooling water flows from the first cooling water passage 46 to the second temperature-responsive valve 60 and alternately from the second cooling water passage 48 to the second temperature-responsive valve 60 depending upon a current temperature of the cooling water and more specifically depending upon the respective open/closed position of the first and second temperature-responsive valves 58, 60.

The configuration of the cross-over conduit 90 can vary from what is shown. In the illustrated example, the cross-over conduit 90 includes a first cross-over conduit portion 92 that connects a cross-over port 94 on the first temperature-responsive valve 58 to a first cross-over port 96 on the pressure-responsive bypass valve 62 and a second cross-over conduit portion 93 that connects a cross-over port 94 on the second temperature-responsive valve 60 to a second cross-over port 100 on the pressure-responsive bypass valve 62. Referring to FIGS. 4 and 5, the cross-over conduit 90 is coupled to the first and second temperature-responsive valves 58, 60 at a location that is upstream of the outlet 68 of the respective valves 58, 60, and more particularly is between the inlet 66 and outlet 68 of the respective valves 58, 60. As mentioned above, the cooling water can flow in either direction in the cross-over conduit 90 depending upon the respective open/closed position of the first and second temperature-responsive valves 58, 60.

Referring to FIGS. 1-3, 6 and 7, the pressure-responsive bypass valve 62 discharges cooling water from the cross-over conduit 90 to the junction fitting 72 and outlet conduit 75 when the cooling water reaches a pressure threshold. In the illustrated example, the pressure-responsive bypass valve 62 is a poppet valve; however the type and/or configuration can vary from what is shown. Other suitable examples include ball valves, check valves, diaphragm valves and/or the like. In the illustrated example, the pressure-responsive bypass valve 62 includes a stem 102 that is biased into the seated position shown in FIG. 7 by a compression spring 104. The stem 102 has a lower surface 103 that faces a plenum 106 that receives flow of cooling water via the first and/or second cross-over ports 96, 100. When the pressure of the cooling water in the plenum 106 applies a force on the lower surface 103 of the stem 102 that is greater than a pressure threshold determined by the bias force provided by the compression spring 104, the stem 102 is causes to move in the direction of arrows 108, against the bias of the compression spring 104. The stem 102 moves in the direction of arrows 108, which opens a pathway for the cooling water in the plenum to flow to a bypass outlet 110 and associated bypass outlet conduit 112 that are connected to the junction fitting 72 and associated outlet conduit 70. The extent of movement of the stem 102 is governed by a flexible membrane 114 connected to the opposite end of the stem 102 by a fastener 118. Once the pressure of the cooling water in the plenum 106 decreases below the pressure threshold, the compression spring 104 moves the stem 102 back into the seated position shown in FIG. 7, wherein flow of cooling water through bypass outlet 110 is prevented. The flexible membrane 114 reduces chatter in the bypass valve 62.

Figure 8:
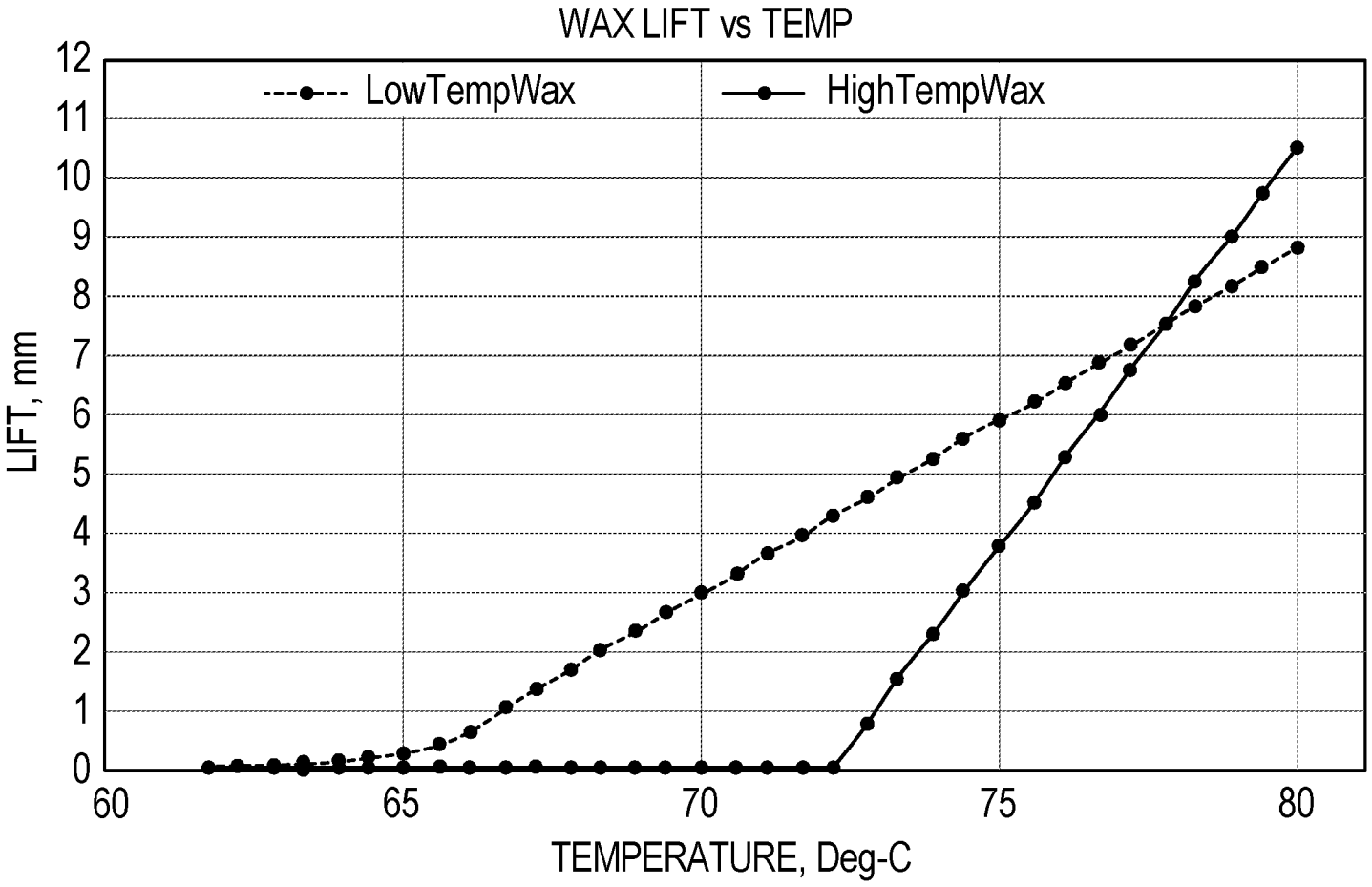
FIG. 8 is a graph plotting valve lift versus temperature for exemplary first and second temperature-responsive valves according to the present disclosure.

Referring to FIG. 8, the type and/or configuration of wax 86 and/or spring 80 in the first and second temperature-responsive valves 58, 60 can be selected by the system designer such that the first temperature-responsive valve 58 advantageously opens at a first rate based upon temperature change of the cooling water and the second temperature-responsive valve 60 opens at a lesser, second rate based upon temperature change of the cooling water. FIG. 8 depicts one non-limiting example of this. As shown by the dashed and solid lines in FIG. 8, as the temperature of the cooling water increases past the noted first temperature threshold of 60 degrees Celsius, the first temperature-responsive valve 58 begins to open. As the temperature of the cooling water further increase past the second temperature threshold of 70 degrees Celsius, the second temperature-responsive valve 60 begins to open. As shown by the lines, because of the different rates, the second temperature-responsive valve 60 advantageously begins to open before the first temperature-responsive valve 58 is fully open, and the first and second temperature-responsive valves are not both fully open until the temperature of the cooling water reaches a third temperature threshold of 80 degrees Celsius, which obviously is greater than the first and second temperature thresholds. It should be noted that FIG. 8 is just one example of the temperature threshold values. Different cooling systems can implement different types wax and springs and thus have different lines on the graph representing opening temperatures and rates.

FIGS. 9-12 schematically depict the example shown in the graph of FIG. 8. FIG. 9 depicts the cooling system 30 when the temperature of the cooling water is below the first temperature threshold, which in this example is 60 degrees Celsius. The cooling water pump 32 pumps the cooling water into the cooling system 30, as described above. The cooling water is not permitted to discharge from the cooling system 30 via the first or second temperature-responsive valves 58, 60 or via the pressure-responsive bypass valve 62. In this state, as the various components of the outboard motor increase in temperature, including the engine block 21 and cylinder head assemblies 22, exhaust manifold 28, etc., and the cooling water will also increase in temperature.

Figure 10:
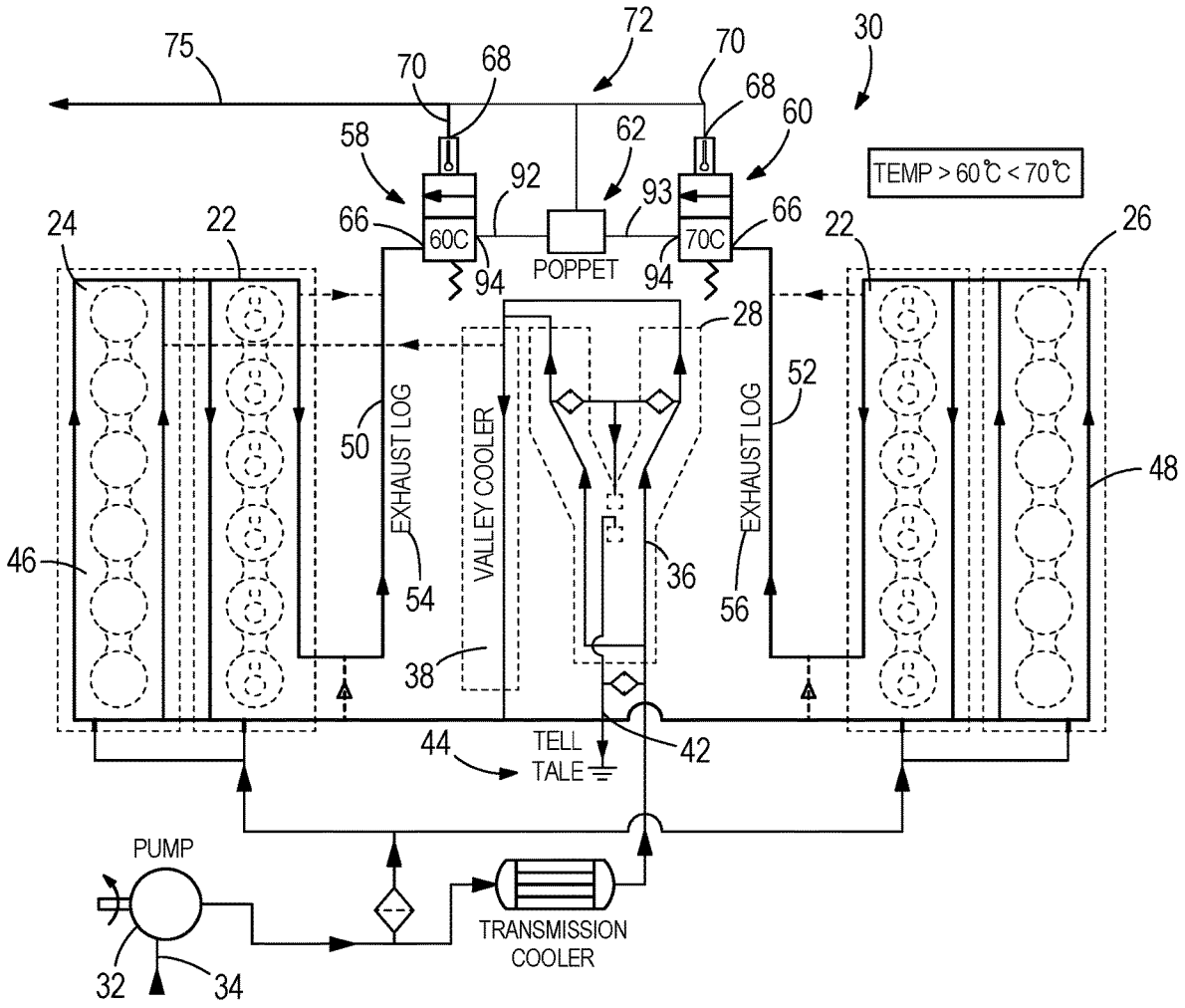

FIG. 10 depicts the cooling system 30 as the temperature of the cooling water increases past the first temperature threshold. In this state, the first temperature-responsive valve 58 begins to open and the cooling water flows from both the of first and second cooling water passages 46, 48 through the first temperature-responsive valve 58. The second temperature-responsive valve 60 and the pressure-responsive bypass valve 62 remain closed.

Figure 11:
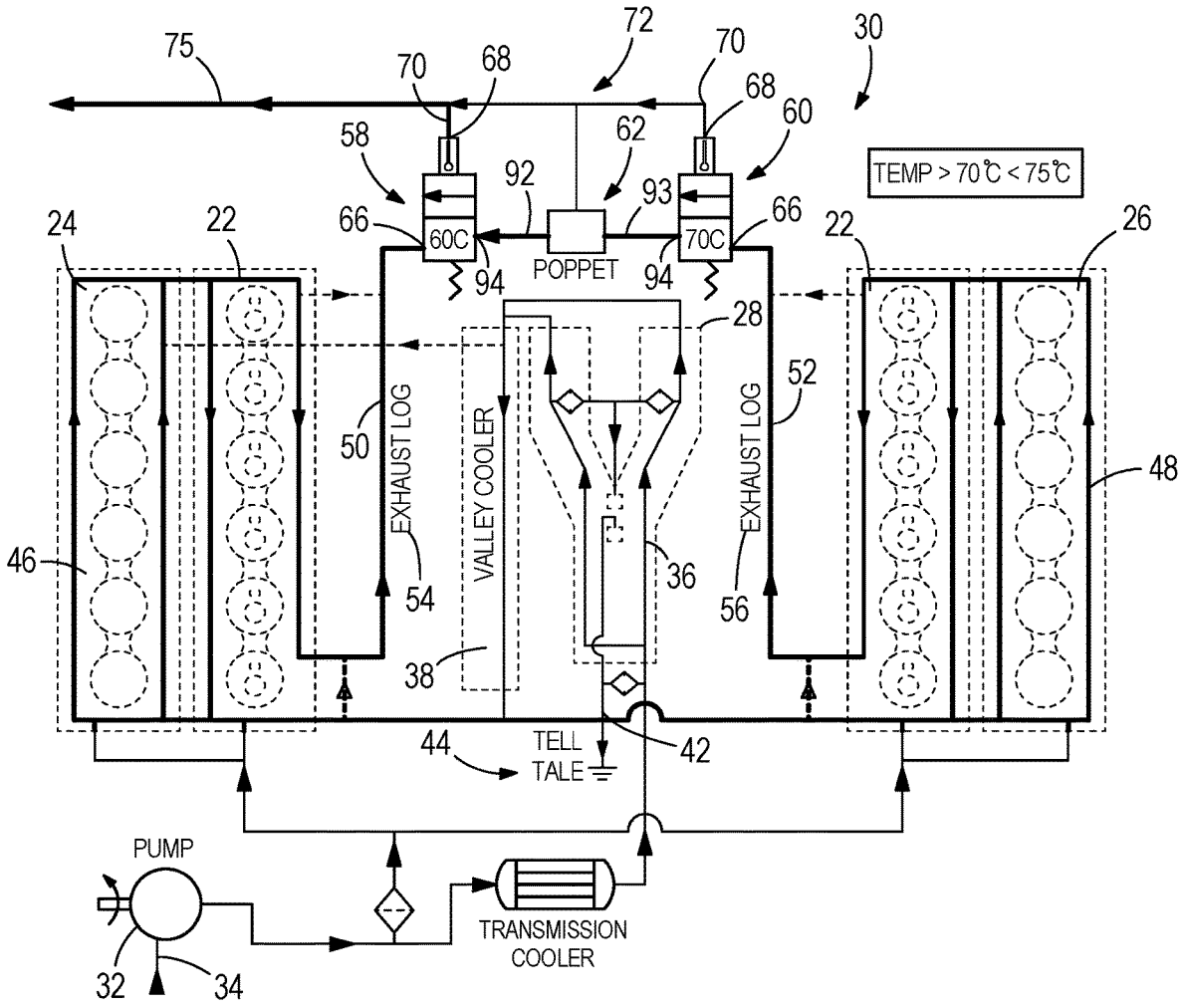

FIG. 11 depicts the cooling system 30 as the temperature of the cooling water increases past the second temperature threshold, which in this example is 70 degrees Celsius. In this state, the second temperature-responsive valve 60 begins to open and the cooling water from the first cooling water passage 46 continues to flow through the first temperature-responsive valve 58 in combination with cooling water from the cooling water passage 48 via the cross-over conduit 90 as the cooling water from the second cooling water passage 48 begins to flow through the second temperature-responsive valve 60. The pressure-responsive bypass valve 62 remains closed. As such, the second temperature-responsive valve 60 begins to open before the first temperature-responsive valve 58 is fully open.

Figure 12:
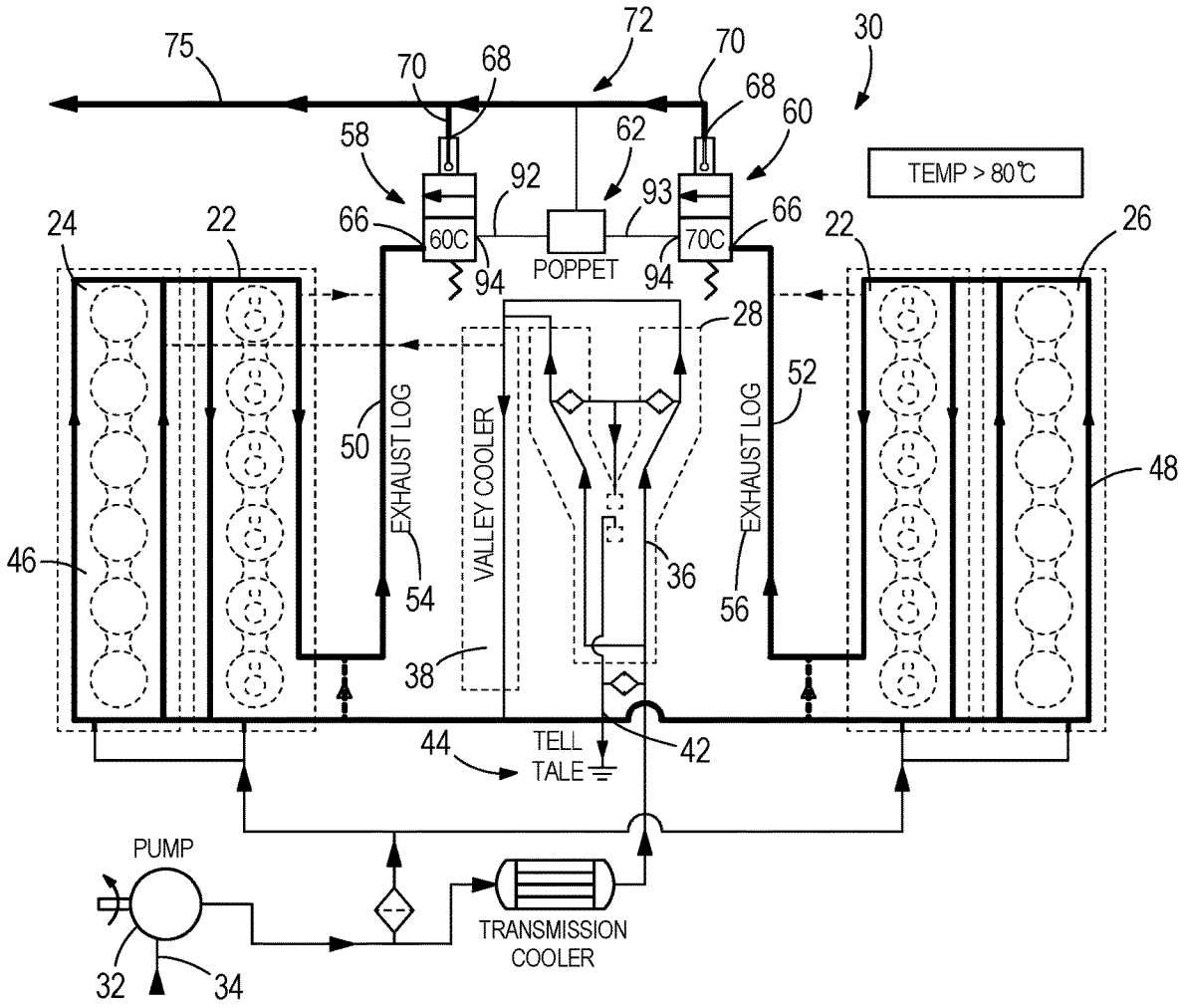

FIG. 12 depicts the cooling system 30 as the temperature of the cooling water increases past the third temperature threshold, which in this example is 80 degrees Celsius. In this state, both the first and second temperature-responsive valves 58, 60 are fully open and the cooling water from the first and second cooling water passages 46, 48 generally flows through the respective first and second temperature-responsive valves 58, 60. The pressure-responsive bypass valve 62 remains closed.

It will be understood by one having ordinary skill in the art that as the temperature of the cooling water decreases, the respective valves 58, 60 will close in the reverse order compared to what is described above, and as depicted in sequence from FIGS. 12-9.

Figure 13:
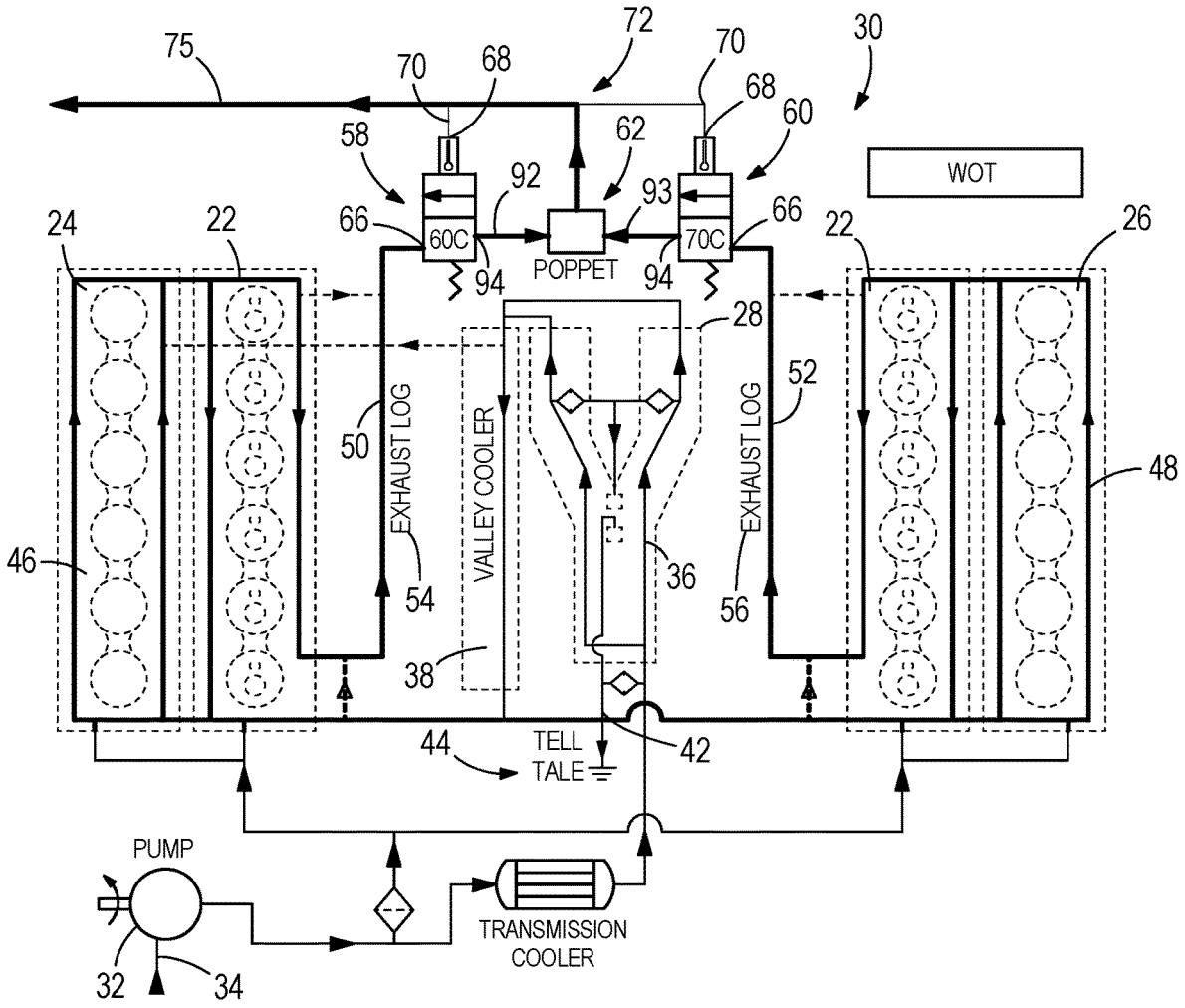

FIG. 13 depicts the cooling system 30 when the pressure of the cooling water increases above the above-noted pressure threshold. This can occur for example when the throttle is rapidly opened at startup. In this state, the pressure-responsive bypass valve 62 opens and permits flow of cooling water from the first and second cooling water passages 46, 48 to the bypass outlet conduit 112 and outlet conduit 75. The first and second temperature-responsive valves 58, 60 typically will be closed in this state, however this is not necessarily always the case. Advantageously, the present inventors determined that the inclusion of the pressure-responsive valve 62 allows the cooling system 30 to better manage temperature overshoots during such transient operations, as compared to the prior art, particularly achieving reduced cycling and reduced warm up time during cold starting.

It should be noted that when the system is pressurized, the pressure-responsive valve opens at a pressure set by the compression spring and provides a small amount of controlled cooling flow. However the pressure-responsive valve is disclosed only as an option for advanced temperature control, and the present inventors have determined that it may not be necessary or needed to achieve a reasonable system with respect to temperature overshoot and cycling. Additionally, the pressure-responsive bypass valve 62 can reference the cooling water anywhere after the pump 32 and before the first and second temperature-responsive valves 58, 60 and discharge anywhere in the outlet conduit 75 and/or independently thereof.

Thus, as shown and described above, the present inventors have determined that it is advantageously possible to provide finer control of cooling water discharge and achieve reduced cycling as operating conditions change over time as compared to prior art. This configuration allows for improved cooling flow control at opening conditions compared to a single (larger) thermostat and also allows the system to reach maximum flow. Providing finer control over the wax and spring 80 was found during testing to reduce cycling across multiple operating conditions. Providing a slower opening rate of change on the low temperature thermostat was found to improve/reduce cycling and yet still provide the ability to open the system and clear contamination. The system 30 advantageously can be tuned by the engine designer, by changing the diameter, lift and/or wax curve of each respective temperature-responsive valve. The system 30 also advantageously permits communication between respective banks of piston-cylinders and therefore achieves uniform cooling of the engine.

During research and experimentation, the present inventors have also determined that it is often desirable to maintain an even amount of restriction to the flow of cooling water through the system 30. The present inventors have determined that in most cases, one of the first and second cooling water passages will in fact provide a greater restriction on the flow of cooling water there through, as compared to the other. This can be a result of different sizes (length, diameter, etc.) of the flow passages, which can be purposeful and according to design. This can also be a result of inherent manufacturing tolerances and/or variances of the respective passages. The present inventors have also realized that the cross-over conduit 90 provides an added restriction on the flow of cooling water that otherwise would not be present in a system wherein the first and second cooling water passages remained separate.

The present inventors have further determined that the system 30 can advantageously be designed so as to minimize the difference in restriction to the flow of cooling water to the first and second temperature-responsive valves 58, 60. As mentioned above, the present inventors have determined that the cross-over conduit 90 adds flow restriction that is in addition to the flow restriction that is inherent in the first and second cooling water passages 46, 48. Upon this realization, the present inventors determined that by purposefully locating the first temperature-responsive valve 58, which opens based upon a lower temperature threshold compared to the second temperature-responsive valve 60, on the same side as the cooling water passage that provides greater restriction (here the first flow passage 46), the cooling system 30 will have better equilibrium, particularly during the majority of operational states in which the first temperature-responsive valve 58 is open and cooling water is flowing from the second cooling water passage 50 through the cross-over conduit 90 to the first temperature-responsive valve 58. That is, the total restriction provided by the first cooling water passage 46 will be closer to equal to the combined restriction provided by the second cooling water passage 48 and the cross-over conduit 90, thus achieving improved flow and temperature equilibrium over the prior art.

The present disclosure thus provides a method of making a marine engine including forming first and second banks of piston-cylinders and first and second cooling water passages that convey cooling water in parallel through the marine engine for cooling the first and second banks of piston-cylinders, respectively; providing a cooling water pump that pumps the cooling water through the first and second cooling water passages; coupling a first temperature-responsive valve to the marine engine, the first temperature-responsive valve being configured to discharge the cooling water from both of the first and second cooling water passages when the cooling water reaches a first temperature threshold; and coupling a second temperature-responsive valve to the marine engine, the second temperature-responsive valve being configured to discharge the cooling water from both of the first and second cooling water passages when the cooling water reaches a second temperature threshold that is greater than the first temperature threshold.

In some examples, the method can include coupling a cross-over conduit to the first and second temperature-responsive valves, the cross-over conduit permitting flow of cooling water from the first cooling water passage to the second temperature-responsive valve and alternately from the second cooling water passage to the first temperature-responsive valve; determining which one of the first and second cooling water passages provides a greater restriction on the flow of cooling water and coupling the first temperature-responsive valve to the one of the first and second cooling water passages that provides the greater restriction, and then coupling the second temperature-responsive valve to the one of the first and second cooling water passages that does not provide the greater restriction such that the cross-over conduit provides an added restriction on the flow of cooling water there-through, which reduces a total difference in restriction on the flows of cooling water through the first and second cooling water passages and to the first and second temperature-responsive valves, respectively.

In the present description, certain terms have been used for brevity, clarity and understanding. No unnecessary limitations are to be inferred therefrom beyond the requirement of the prior art because such terms are used for descriptive purposes only and are intended to be broadly construed.

What is claimed is:

1. A marine engine comprising:

first and second banks of piston-cylinders;

first and second cooling water passages that convey cooling water in parallel alongside the first and second banks of piston-cylinders, respectively;

a cooling water pump that pumps the cooling water through the first and second cooling water passages;

a first temperature-responsive valve configured to discharge the cooling water from both of the first and second cooling water passages when the cooling water reaches a first temperature threshold;

a second temperature-responsive valve configured to discharge the cooling water from both of the first and second cooling water passages when the cooling water reaches a second temperature threshold that is greater than the first temperature threshold; and a cross-over conduit coupled to the first and second temperature-responsive valves, the cross-over conduit permitting flow of cooling water from the first cooling water passage to the second temperature-responsive valve and alternately from the second cooling water passage to the first temperature-responsive valve.

2. The marine engine according to claim 1, wherein the first temperature-responsive valve is coupled to the marine engine closer to the first bank of piston-cylinders than the second bank of piston-cylinders, and wherein the second temperature-responsive valve is coupled to the marine engine closer to the second bank of piston-cylinders than the first bank of piston-cylinders.

3. The marine engine according to claim 2, wherein the first cooling water passage provides a greater restriction on the flow of cooling water than the second cooling water passage.

4. The marine engine according to claim 3, wherein the cross-over conduit provides an added restriction on the flow of cooling water that reduces a total difference in restriction on the flows of cooling water through the first and second cooling water passages and to the first and second temperature-responsive valves, respectively.

5. The marine engine according to claim 1, wherein the first temperature-responsive valve is coupled to the marine engine above the first bank of piston-cylinders and wherein the second temperature-responsive valve is coupled to the marine engine above the second bank of piston-cylinders.

6. The marine engine according to claim 1, wherein the first temperature-responsive valve opens at a first rate based upon temperature change and wherein the second temperature-responsive valve opens at a second rate based upon temperature change and wherein the first rate is slower than the second rate.

7. A marine engine comprising:

first and second banks of piston-cylinders;

first and second cooling water passages that convey cooling water in parallel alongside the first and second banks of piston-cylinders, respectively;

a cooling water pump that pumps the cooling water through the first and second cooling water passages;

a first temperature-responsive valve configured to discharge the cooling water from both of the first and second cooling water passages when the cooling water reaches a first temperature threshold; and a second temperature-responsive valve configured to discharge the cooling water from both of the first and second cooling water passages when the cooling water reaches a second temperature threshold that is greater than the first temperature threshold;

wherein the first temperature-responsive valve is coupled to the marine engine closer to the first bank of piston-cylinders than the second bank of piston-cylinders, and wherein the second temperature-responsive valve is coupled to the marine engine closer to the second bank of piston-cylinders than the first bank of piston-cylinders; and further comprising a cross-over conduit that permits flow of the cooling water from the first cooling water passage to the second temperature-responsive valve and alternately from the second cooling water passage to the first temperature-responsive valve.

8. The marine engine according to claim 7, wherein cooling water flows from the first cooling passage to the second temperature-responsive valve and alternately from the second cooling water passage to the first temperature-responsive valve depending upon a current temperature of the cooling water.

9. The marine engine according to claim 7, further comprising a pressure-responsive bypass valve that allows cooling water to bypass the first and second temperature-responsive valves when the cooling water reaches a pressure threshold.

10. The marine engine according to claim 9, wherein the pressure-responsive bypass valve comprises a poppet.

11. The marine engine according to claim 7, wherein each of the first and second temperature-responsive valves comprises a body having an inlet that receives the cooling water and an outlet that discharges the cooling water and a temperature-responsive element that based upon a current temperature of the cooling water automatically opens to allows flow of the cooling water from the inlet to the outlet and automatically closes to prevent flow of the cooling water from the inlet to the outlet.

12. The marine engine according to claim 11, wherein the cross-over conduit is coupled to the first and second temperature-responsive valves upstream of the outlets of the first and second temperature-responsive valves.

13. The marine engine according to claim 12, wherein the cross-over conduit is coupled to the bodies of the first and second temperature-responsive valves between the inlets and outlets of the first and second temperature-responsive valves.

14. A marine engine comprising:

first and second banks of piston-cylinders;

first and second cooling water passages that convey cooling water in parallel alongside the first and second banks of piston-cylinders, respectively;

a cooling water pump that pumps the cooling water through the first and second cooling water passages;

a first temperature-responsive valve configured to discharge the cooling water from both of the first and second cooling water passages when the cooling water reaches a first temperature threshold; and a second temperature-responsive valve configured to discharge the cooling water from both of the first and second cooling water passages when the cooling water reaches a second temperature threshold that is greater than the first temperature threshold;

wherein the first temperature-responsive valve opens at a first rate based upon temperature change and wherein the second temperature-responsive valve opens at a second rate based upon temperature change and wherein the first rate is slower than the second rate; and wherein as temperature of the cooling water increases past the first temperature threshold, the first temperature-responsive valve begins to open; and wherein as the temperature of the cooling water further increases past the second temperature threshold, the second temperature-responsive valve begins to open; and wherein the second temperature-responsive valve begins to open before the first temperature-responsive valve is fully open.

15. The marine engine according to claim 14, wherein the first and second temperature-responsive valves are not both fully opened until the temperature of the cooling water reaches a third temperature threshold that is greater than the first and second temperature thresholds.

16. A marine engine comprising:

first and second banks of piston-cylinders;

first and second cooling water passages that convey cooling water in parallel alongside the first and second banks of piston-cylinders, respectively;

a cooling water pump that pumps the cooling water from through the first and second cooling water passages;

a first temperature-responsive valve configured to allow flow of the cooling water from the marine engine when the cooling water reaches a first temperature threshold;

a second temperature-responsive valve configured to allow flow of the cooling water from the marine engine when the cooling water reaches a second temperature threshold that is greater than the first temperature threshold; and a cross-over conduit that permits flow of the cooling water from the first cooling water passage to the second temperature-responsive valve and alternately from the second cooling water passage to the first temperature-responsive valve, wherein cooling water flows from the first cooling passage to the second temperature-responsive valve and alternately from the second cooling water passage to the first temperature-responsive valve depending upon a current temperature of the cooling water;

wherein as temperature of the cooling water increases past the first temperature threshold, the first temperature-responsive valve begins to open and the cooling water flows from both of the first and second cooling water passages to the first temperature-responsive valve; and wherein as the temperature of the cooling water further increases past the second temperature threshold, the second temperature-responsive valve begins to open and the cooling water from the first cooling passage continues to flow through the first temperature-responsive valve and the cooling water from the second cooling passage begins to flow through the second temperature-responsive valve.

17. The marine engine according to claim 16, wherein the second temperature-responsive valve begins to open before the first temperature-responsive valve is fully open, and wherein the first and second temperature-responsive valves are not both fully opened until the temperature of the cooling water reaches a third temperature threshold that is greater than the first and second temperature thresholds.

18. A method of making a marine engine, the method comprising:

forming first and second banks of piston-cylinders and first and second cooling water passages that convey cooling water in parallel alongside the first and second banks of piston-cylinders for cooling the first and second banks of piston-cylinders, respectively;

providing a cooling water pump that pumps the cooling water through the first and second cooling water passages;

coupling a first temperature-responsive valve to the marine engine, the first temperature-responsive valve being configured to discharge the cooling water from both of the first and second cooling water passages when the cooling water reaches a first temperature threshold; and coupling a second temperature-responsive valve to the marine engine, the second temperature-responsive valve being configured to discharge the cooling water from both of the first and second cooling water passages when the cooling water reaches a second temperature threshold that is greater than the first temperature threshold; and further comprising coupling a cross-over conduit to the first and second temperature-responsive valves, the cross-over conduit permitting flow of cooling water from the first cooling water passage to the second temperature-responsive valve and alternately from the second cooling water passage to the first temperature-responsive valve.

19. The method according to claim 18, further comprising determining which one of the first and second cooling water passages provides a greater restriction on the flow of cooling water and coupling the first temperature-responsive valve to the one of the first and second cooling water passages that provides the greater restriction, and then coupling the second temperature-responsive valve to the one of the first and second cooling water passages that does not provide the greater restriction such that the cross-over conduit provides an added restriction on the flow of cooling water therethrough, which reduces a total difference in restriction on the flows of cooling water through the first and second cooling water passages and to the first and second temperature-responsive valves, respectively.

* * * * *